US009303859B2

(12) United States Patent
Horng et al.

(10) Patent No.: US 9,303,859 B2
(45) Date of Patent: Apr. 5, 2016

(54) ILLUMINATING VENTILATOR

(71) Applicant: Sunonwealth Electric Machine Industry Co., Ltd., Kaohsiung (TW)

(72) Inventors: Alex Horng, Kaohsiung (TW); Chien-Chih Chen, Kaohsiung (TW); Cheng-Wei Lin, Kaohsiung (TW); Shih-Ting Wu, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 71 days.

(21) Appl. No.: 14/451,472

(22) Filed: Aug. 5, 2014

(65) Prior Publication Data

US 2015/0117034 A1 Apr. 30, 2015

(30) Foreign Application Priority Data

Oct. 30, 2013 (TW) ..... 102139377 A

(51) Int. Cl.

| | |
|---|---|
| ***F21V 33/00*** | (2006.01) |
| ***F21V 29/67*** | (2015.01) |
| ***F21V 19/04*** | (2006.01) |
| ***F04D 29/00*** | (2006.01) |
| ***F04D 17/16*** | (2006.01) |
| ***F24F 13/078*** | (2006.01) |

(52) U.S. Cl.

CPC ..... *F21V 29/677* (2015.01); *F04D 17/16* (2013.01); *F04D 29/005* (2013.01); *F21V 19/04* (2013.01); *F21V 33/0096* (2013.01); *F24F 13/078* (2013.01)

(58) Field of Classification Search

CPC ..... F04D 17/16; F04D 19/00; F04D 29/58; F21V 1/00; F24F 13/078

USPC ..... 362/96, 147

See application file for complete search history.

(56) References Cited

U.S. PATENT DOCUMENTS

| | | | | |
|---|---|---|---|---|
| 5,934,783 | A * | 8/1999 | Yoshikawa | F21V 33/0096 362/149 |
| 7,037,073 | B2 * | 5/2006 | Lin | F04D 25/0613 362/500 |
| 8,287,152 | B2 * | 10/2012 | Gill | F21S 2/005 362/249.02 |
| 8,304,652 | B2 * | 11/2012 | McBain | H01R 13/443 174/66 |
| 8,770,774 | B2 | 7/2014 | Ye et al. | |
| 2008/0013315 | A1 * | 1/2008 | Kim | G02B 6/0021 362/235 |
| 2010/0009621 | A1 * | 1/2010 | Hsieh | F21V 33/0096 454/293 |

FOREIGN PATENT DOCUMENTS

CN 201991805 U 9/2011

* cited by examiner

*Primary Examiner* — Ali Alavi

(74) *Attorney, Agent, or Firm* — Alan D. Kamrath; Kamrath IP Lawfirm, P.A.

(57) ABSTRACT

An illuminating ventilator including a fan, a connecting frame, a lamp seat and a cover is provided. The fan has a housing and a fan wheel, wherein the housing has a first coupling portion, an inlet, an outlet and an inner space communicating with said inlet and outlet, and the fan wheel is received in the inner space. The connecting frame couples with the housing and has an opening in alignment with the inlet of the housing, wherein the connecting frame has a second coupling portion coupling with the first coupling portion of the housing. The lamp seat is mounted on one of the connecting frame and housing and has a receiving portion for receiving a lamp. The cover is coupled with the connecting frame and has a plurality of apertures communicating with the opening.

14 Claims, 9 Drawing Sheets

ILLUMINATING VENTILATOR

BACKGROUND OF THE INVENTION

1. Field of the Invention

The present invention generally relates to a ventilator and, more particularly, it relates to an illuminating ventilator with illumination function.

2. Description of the Related Art

Referring to FIG. 1, a conventional illuminating ventilator 8 of a China patent, entitled as "Ventilator," with patent publication number of 201991805 is shown, which includes a housing 81, an inlet cover 82 coupled with the housing 81 to form a receiving space in the combination of the housing and inlet cover 82, and a fan 83 received in said receiving space. There is also an illuminating device 84 received in the receiving space between the inlet cover 82 and fan 83, wherein the illuminating device 84 includes a seat 841 and a light-emitting unit 842. With the above described structure, the illuminating ventilator not only is able to generate airflow by operating the fan 83, but also provides an ideal illumination since rays generated by the light-emitting unit 842 are able to be emitted out of the housing 81 via the inlet cover 82 without being blocked by the fan 83.

Conventionally, the light-emitting unit 842 of the illuminating device 84 is an incandescent lamp or a fluorescent lamp, which is usually connected with an inner surface of the housing 81 and arranged between the inlet cover 82 and fan 83. However, with this arrangement, it is impossible to largely decrease a required length between the inlet cover 82 and fan 83 since the seat 841 is arranged on the inner surface of the housing 81 and choices in size of the incandescent lamp or fluorescent lamp are limited. Besides, in order to connect with the illuminating device 84, the shape of a part of the housing close to an inlet of the fan 83 cannot be adjusted to enhance the air-guiding performance or to lower the wind noise of in operation. Moreover, the heat generated by the seat 841 and light-emitting unit 842 during operation cannot be efficiently drawn by the fan 83 since the illuminating device 84 is arranged in a corner area of the receiving space away from the route wherein the airflow goes.

Therefore, another conventional illuminating ventilator 9 with illumination function, which is published by a Taiwan patent application with publication number of 201315939 and entitled as "Illuminating Ventilator," is proposed and shown in FIG. 2. This illuminating ventilator 9 includes a base casing 91, a LED module 92, a lampshade 93, and a shield 94. The LED module 92 is received in the base casing 91, the lampshade 93 couples with the base casing 91 to jointly enclose the LED module 92 with the base casing 91, and the shield 94 connects with the lampshade 93. This conventional illuminating ventilator 9 can have improved performance in air-guiding and noise suppression since the LED module 92 is small and thin enough to prevent from blocking the airflow entering a fan inside the illuminating ventilator 9.

However, there is still a drawback of this illuminating ventilator 9. The LED module 92 includes a light board 921, a heat transmitting plate 922, a ray guiding film 923, and a waterproof washer 924. Once the light board 921 malfunctions, the user usually has to replace the whole of the LED module 92 since the light board 921 is specially designed to be used in the LED module 92 and is not a common product for commerce. Therefore, the cost for repair of the illuminating ventilator 9 is high.

Moreover, according to various needs in performances of air capacity and illumination, the producers of the conventional illuminating ventilator has to design and manufacture various types of illuminating ventilators, which include illuminating devices of different power requirements and fans of different rated speeds and sizes. Specifically, for the conventional illuminating ventilator 8, since the frame of the fan 83 is constructed by a part of the housing 81 integrally, the housing 81 has to be changed for adapting to fans 83 with different sizes. Similarly, the housing 81 also has to be changed for adapting to different kinds of seats 841 since there is no such a seat 841 can be suitable to all kinds of various light-emitting units 842. The above described problems also exist in the illuminating ventilator 9, wherein the sizes and shapes of the base casing 91 and lampshade 93, even the shield 94, have to be changed when the illuminating ventilators 9 with different LED modules 92 are needed. In sum, both of the conventional illuminating ventilators 8, 9 may result in high cost in manufacture when various requirements in performances are made by customers.

As a result, it is necessary to improve the conventional illuminating ventilators 8, 9 with drawbacks such as "large size," "bad cooling performance," "low convenience in use" and "high cost in manufacture," so as to efficiently save the costs in design and in dies/molds for making various types of illuminating ventilators.

SUMMARY OF THE INVENTION

It is therefore the objective of this invention to provide an illuminating ventilator, which includes a fan, a connecting frame and a lamp seat, a housing of the fan connects with the connecting frame, and the lamp seat connects with the connecting frame or housing, so that additional dies/molds for manufacturing different kinds of connecting frame is avoided when it is necessary to produce illuminating ventilators with various fans or lamp seats. Therefore, cost of manufacture is reduced.

Another objective of this invention is providing an illuminating ventilator, whose lamp seat includes a receiving portion for receiving a lamp, with the receiving portion in alignment with an opening of the connecting frame, and with the opening in alignment with an inlet of the housing, so that airflows generated by the fan can cool the lamp when passing through the opening of the connecting frame. Therefore, performance of cooling is improved.

Further another objective of this invention is providing an illuminating ventilator, wherein the connecting frame is coupled with a cover having a plurality of apertures communicating with the opening, the cover further has a light-transmittable portion in alignment with the receiving portion of the lamp seat for the lamp to be exposed to the outside of the cover. Therefore, the convenience in use is improved since the lamp can be removed without detachment of the cover.

One embodiment of the invention discloses an illuminating ventilator, which includes a fan, a connecting frame, a lamp seat and a cover. The fan has a housing and a fan wheel, wherein the housing has a first coupling portion, an inlet, an outlet and an inner space communicating with said inlet and outlet, and the fan wheel is received in the inner space. The connecting frame couples with the housing and has an opening in alignment with the inlet of the housing, wherein the connecting frame has a second coupling portion coupling with the first coupling portion of the housing. The lamp seat is mounted on one of the connecting frame and housing and has a receiving portion for receiving a lamp. The cover is coupled with the connecting frame and has a plurality of apertures communicating with the opening.

In a preferred form shown, the lamp seat is mounted on a surface of the connecting frame, said surface faces away from the housing and is close to the opening, the receiving portion is formed on a side of the connecting frame, and said side is away from the housing.

In a preferred form shown, the lamp seat is mounted on a surface of the housing and extends through the opening of the connecting frame, said surface faces the connecting frame, the receiving portion is formed on a side of the connecting frame, and said side is away from the housing.

In a preferred form shown, the cover has a light-transmittable portion in alignment with the receiving portion of the lamp seat.

In the preferred form shown, the light-transmittable portion is a through hole for the lamp to be passed therethrough.

In a preferred form shown, the receiving portion of the lamp seat is in alignment with the inlet of the housing.

In a preferred form shown, each of the first and second coupling portions has a plurality of holes, the plurality of holes of the first coupling portion serving as the first coupling portion is aligned with the plurality of holes of the second coupling portion serving as the second coupling portion respectively, and a plurality of fixing member penetrates aligned pairs of the holes.

In a preferred form shown, the connecting frame has a first connecting portion, the lamp seat has a second connecting portion, and the first and second connecting portions connect with each other.

In the preferred form shown, each of the first and second connecting portions has a plurality of holes, the plurality of holes of the first coupling portion serving as the first connecting portion is aligned with the plurality of holes of the second coupling portion serving as the second connecting portion respectively, and a plurality of fixing member penetrates aligned pairs of the holes.

In a preferred form shown, a socket is arranged inside the receiving portion for electrically connecting to the lamp.

In a preferred form shown, the housing connects with a container for containing a power supply for the fan or the lamp.

In a preferred form shown, the connecting frame has a receiving room inside, the fan is received in the receiving room, the opening of the connecting frame serves as a first opening, the connecting frame further has a second opening, the first and second openings communicate with the receiving room, the first opening aligns with the inlet, and the second opening aligns with the outlet.

In a preferred form shown, the lamp received in the receiving portion of the lamp seat is a light-emitting module, the receiving portion has a socket for electrically connecting with the lamp.

In the preferred form shown, the lamp has a first fixing member, the lamp seat has a second fixing member, and the first and second fixing members detachably engage with each other.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
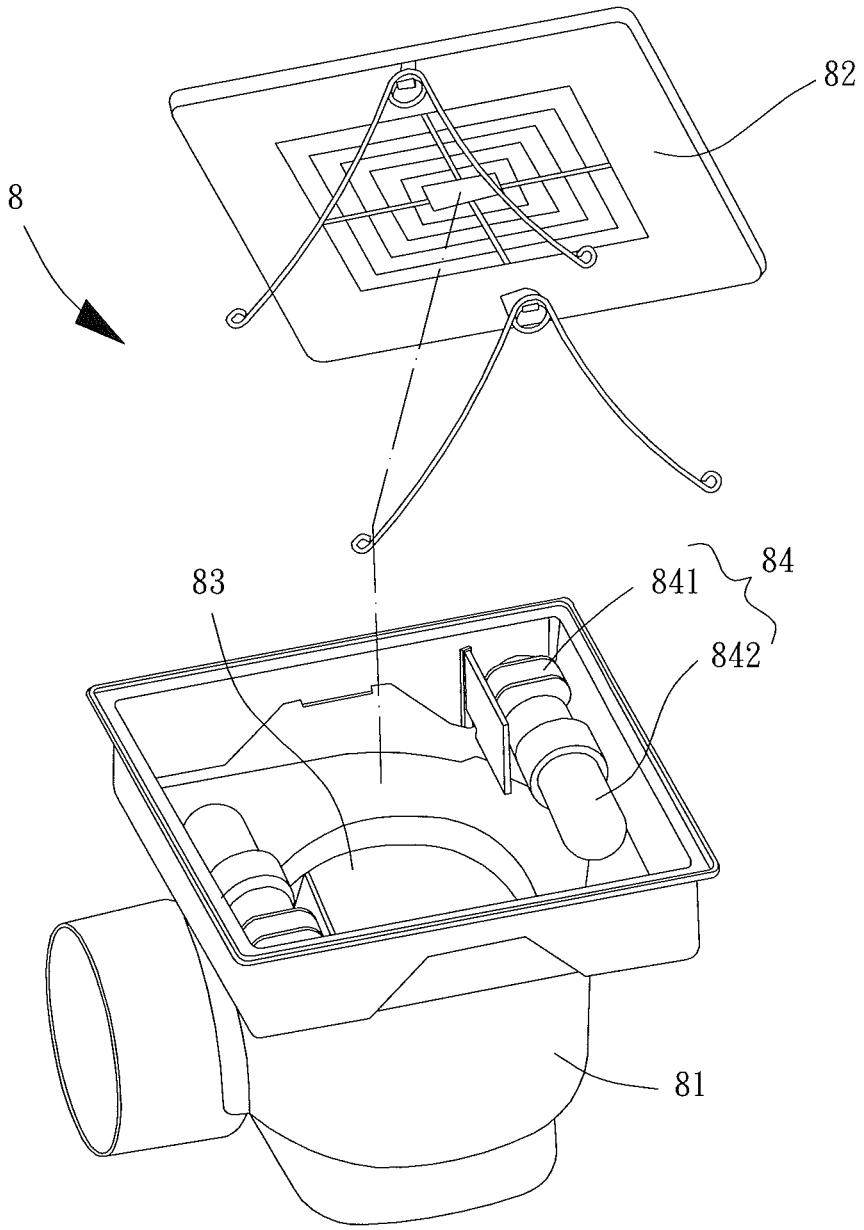
FIG. 1 PRIOR ART
FIG. 1 is an exploded and perspective view of a conventional illuminating ventilator.
Figure 2:
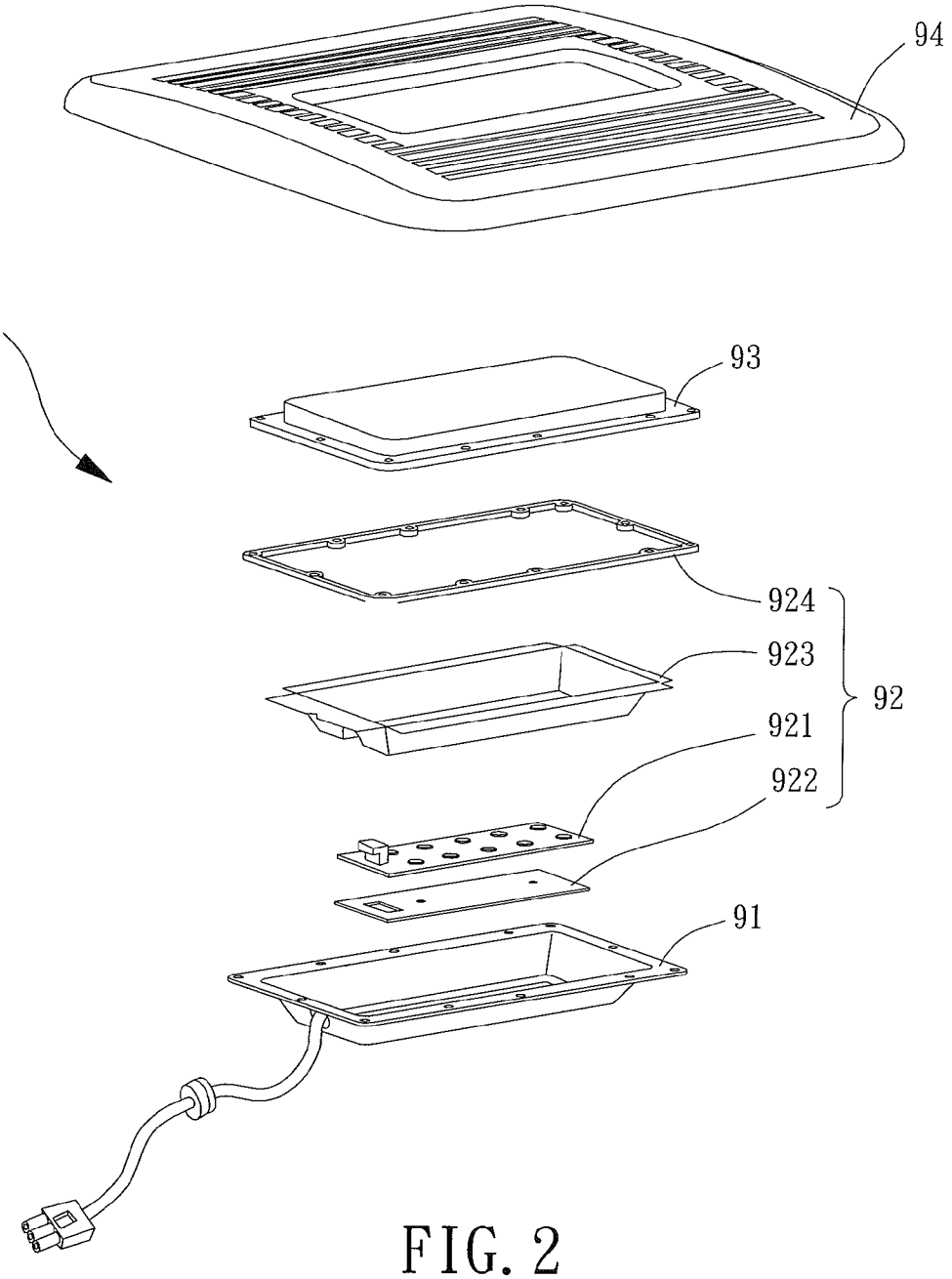
FIG. 2 PRIOR ART
FIG. 2 is another exploded and perspective view of a conventional illuminating ventilator.

In the various figures of the drawings, the same numerals designate the same or similar parts. Furthermore, when the term "first," "second," "inner," and similar terms are used hereinafter, it should be understood that these terms refer only to the structure shown in the drawings as it would appear to a person viewing the drawings, and are utilized only to facilitate describing the invention.

DETAILED DESCRIPTION OF THE INVENTION

Figure 3:
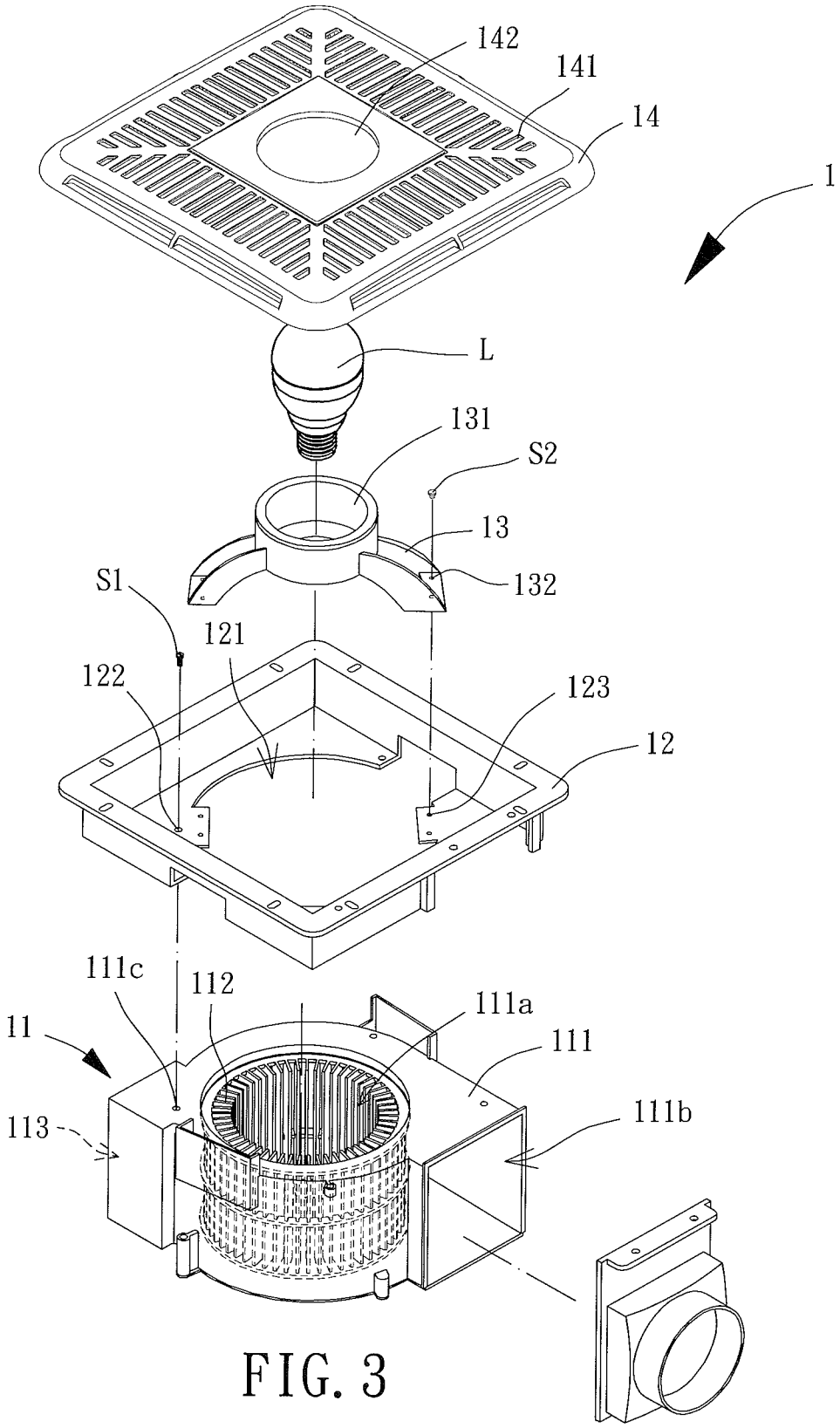
FIG. 3 is an exploded and perspective view of an illuminating ventilator according to a first embodiment of the invention.

Referring to FIG. 3, a first embodiment of an illuminating ventilator is shown and indicated by a reference number of "1," which includes a fan 11, a connecting frame 12, a lamp seat 13, and a cover 14.

The fan 11 has a housing 111 and a fan wheel 112 received in an inner space of the housing 111. The housing 111 has an inlet 111*a* and an outlet 111*b*, with both inlet 111*a* and outlet 111*b* connecting with said inner space, so that the fan wheel 112 is able to inhale air into the inner space via the inlet 111*a*, to form an airflow in the housing 111, and to guide the airflow out via the outlet 111*b* by rotation. The fan 11 can be a centrifugal fan or other conventional fan. Besides, a side of the housing 111, where the inlet 111*a* is arranged, further has a first coupling portion 111*c*.

The connecting frame 12 couples with the housing 111 of the fan 11 and has an opening 121 in alignment with the inlet 111*a* of the housing 111, wherein the opening 121 has a diameter larger than that of the inlet 111*a* and thus the connecting frame 12 does not block the route for air to enter the housing 111 via the inlet 111*a*. Furthermore, the connecting frame 12 has a second coupling portion 122 corresponding to and for coupling with the first coupling portion 111*c*. In this first embodiment, both of the first coupling portion 111*c* and second coupling portion 122 include a plurality of holes, and the holes serving as the first coupling portion 111*c* align with those serving as the second coupling portion 122 respectively. With a plurality of fixing member S1 such as screws or rivets penetrating aligned pairs of the holes, the housing 111 can firmly couple with the connecting frame 12. Alternatively, in addition to the above structure, the first and second coupling portions 111*c*, 122 can also be implemented by other conventional structures such as tenoning, fastening, adhesion or screwing.

The lamp seat 13 is mounted on the connecting frame 12 and includes a receiving portion 131 to receive a lamp "L," and there is a socket arranged inside the receiving portion 131 for the lamp "L" to electrically connect to a power supply through said socket. The receiving portion 131 is preferably in alignment with the opening 121 of the connecting frame 12 and the inlet 111*a* of the housing 111, with a space "R" formed between said receiving portion 131 and opening 121. Furthermore, preferably, the lamp seat 13 connects to a surface of the connecting frame 12, with said surface facing away from the housing 111 and close to the opening 121, so that the receiving portion 131 is formed on a side of the connecting frame 12 away from the housing 111. In this embodiment, the connecting frame 12 has a first connecting portion 123 and the lamp seat 13 has a second connecting portion 132, wherein the first and second connecting portions 123, 132 are adapted to connect with each other. Specifically, both of the first connecting portion 123 and second connecting portion 132 include a plurality of holes, and the holes serving as the first connecting portion 123 align with those serving as the second connecting portion 132 respectively. With a plurality of fixing member S2 such as screws or rivets penetrating aligned pairs of the holes, the connecting frame 12 can firmly couple with the lamp seat 13. Alternatively, in addition to the above structure, the first and second connecting portions 123, 132 can also be implemented by other conventional structures such as tenoning, fastening or screwing.

The cover 14 has a shape of a rectangle preferably and is also coupled with the connecting frame 12. The cover 14 has a plurality of apertures 141 communicating with the opening 121, and the diameter of each aperture 141 is smaller than that of the opening 121 so as to prevent dirt from entering the fan 11. Besides, the cover 14 further includes a light-transmittable portion 142 in alignment with the receiving portion 131 of the lamp seat 13. Therefore, rays generated by the lamp "L," which is disposed in the receiving portion 131, can be transmitted outwards through the light-transmittable portion 142. In this embodiment, the light-transmittable portion 142 is a through hole for the lamp "L" to be exposed or to extend through the cover 14. However, the light-transmittable portion 142 can also be a transparent plate or other light-transmittable structure.

Figure 4:
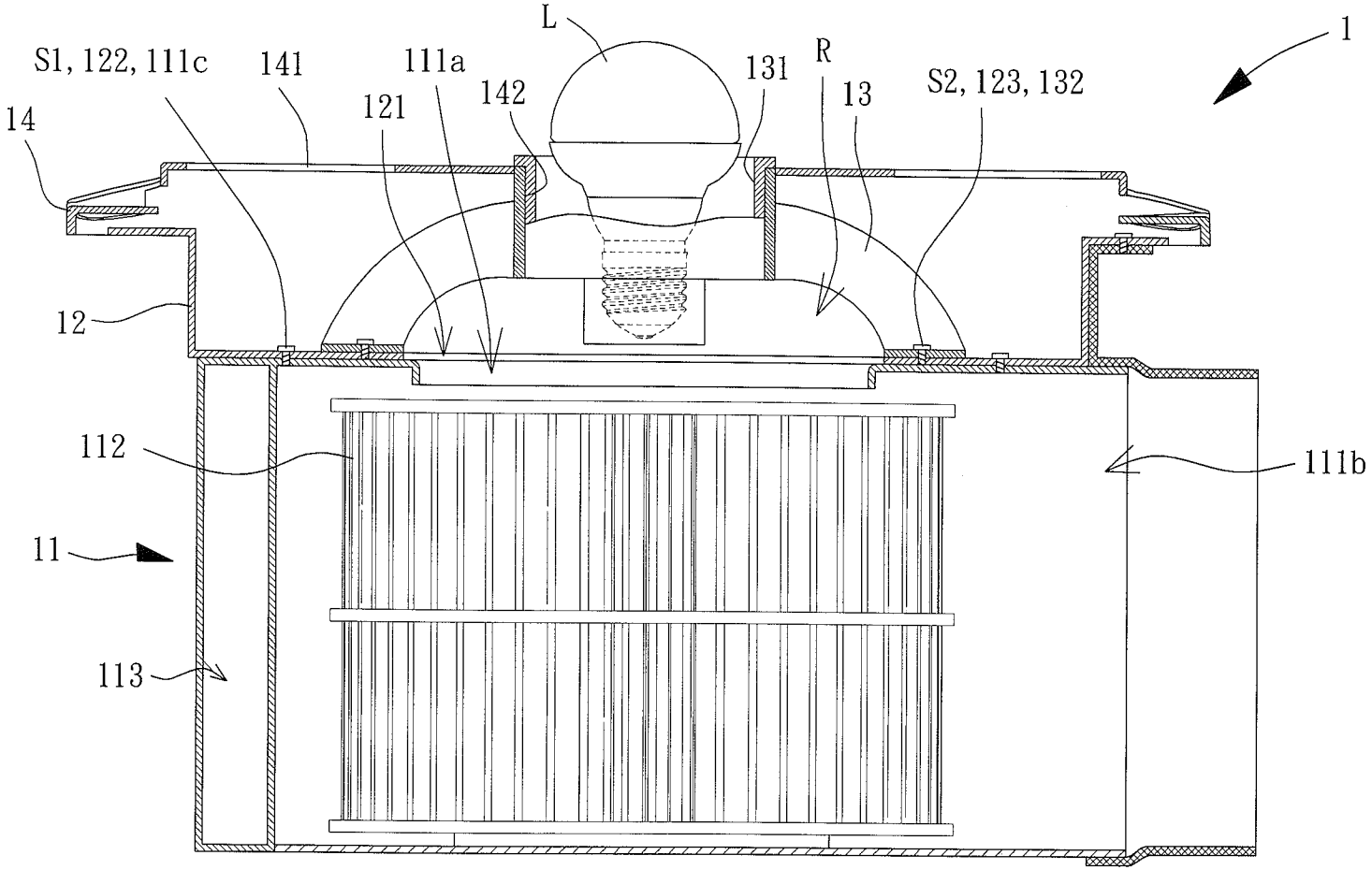
FIG. 4 is a cross-sectional view of the illuminating ventilator according to the first embodiment.

Please refer to FIGS. 3 and 4 now. In use, the connecting frame 12 is adapted to connect to a ceiling or a wall. When the fan wheel 112 of the fan 11 turns, an airflow is thus generated and passes through the apertures 141, opening 121, inlet 111*a*, inner space of the housing 111, and outlet 111*b* sequentially, so that the illuminating ventilator 1 can achieve its ventilation function. The lamp "L" operates when receiving electrical power from the power supply via the socket in the receiving portion 131, and thus emits rays out through the light-transmittable portion 142 to achieve the illustration function. Furthermore, in addition to the above functions, the space "R" between said receiving portion 131 and opening 121 ensures that the air can smoothly flow from the apertures 141 to the opening 121 without being blocked by the lamp seat 13 and lamp "L," and thus maintains a desirable performance in ventilation.

Referring to FIG. 3 again, the fan 11 can further include a container 113 integrally connecting with the housing 111 to contain the power supply providing electrical power to the fan 11 or lamp "L." Said power supply can be a conventional power supply module, such as a transformer, an AC/DC converter, a battery, or a regulator. With the container 113, a user can easily settle the illuminating ventilator 1 into a predetermined position in the ceiling or wall and need not to additionally handle the connection between the power supply and the fan 11 or lamp "L."

With the housing 111 combining with the connecting frame 12 through the first and second coupling portions 111*c*, 122 coupled with each other, the fan 11 and connecting frame 12 are two elements independently formed. Therefore, when it is necessary to provide multiple kinds of illuminating ventilators 1 with fans 11 of different sizes, only one kind of the connecting frame 12 has to be designed and manufactured for connecting with various kinds of fans 11 having the same second coupling portion 122, and thus no additional die/mold for the connecting frame 12 is necessary. Similarly, with the connecting frame 12 combining with the lamp seat 13 through the connecting portions 123, 132 coupled with each other, the fan 11 connecting frame 12 and lamp seat 13 are two elements independently formed. Therefore, when it is necessary to provide multiple kinds of illuminating ventilators 1 with lamps "L" of different types, only one kind of the connecting frame 12 has to be designed and manufactured for connecting with various kinds of lamp seats 13, which are suitable for different lamps "L" and have the same second coupling portion 122, and no additional die/mold for the connecting frame 12 is necessary. As a result, the manufacturing cost for the illuminating ventilator 1 of the first embodiment is actually lowered.

Moreover, in comparison with the conventional illuminating ventilator 8 that has to arrange the seat 841 on the inner surface of the housing 81 and is impossible to reduce the thickness between the inlet cover 82 and fan 83, with the receiving portion 131 being in alignment with the inlet 111*a* and the lamp "L" protruding from the cover 14 via the light-transmittable portion 142, it is not necessary to keep a distance between the connecting frame 12 and cover 14, which has to be sufficient to totally include the lamp "L," and thus the thickness of the connecting frame 12 between the fan 11 and cover 14 is small. Additionally, since the receiving portion 131 is in alignment with the inlet 111*a* as well as the space "R" is arranged between the receiving portion 131 and opening 121, the airflow inputted via the apertures 141 not only can smoothly enter the fan 11, but also cools the lamp "L" when passing through the lamp "L."

Furthermore, because the lamp "L" is not limited to any specific illuminating device and a commercially acquirable lamp such as an incandescent lamp including conventional bulb and Halogen lamp, an fluorescent lamp including daylight lamp and energy-saving lamp, or an LED lamp is adequate, it is really convenient for an user to replace the lamp "L" by another one if necessary. Besides, since the lamp "L" is exposed to the outside through the light-transmittable portion 142 of the cover 14, the user can easily disengage the lamp "L" from the socket in the receiving portion 131 without detaching the cover 14 from the connecting frame 12. Accordingly, the convenience in use of the illuminating ventilator 1 is much higher than those of the conventional illuminating ventilators 8, 9.

Figure 5:
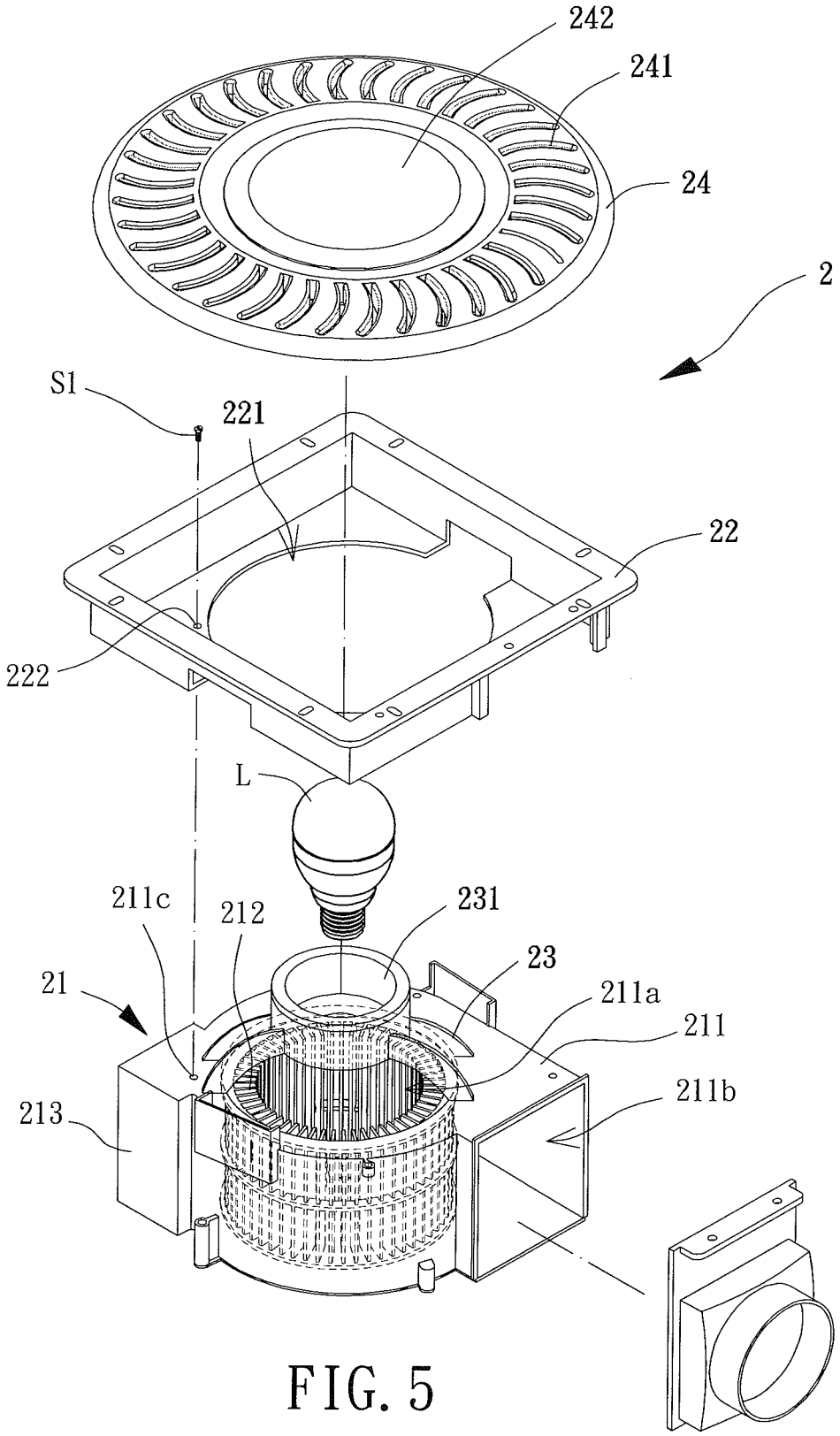
FIG. 5 is an exploded and perspective view of an illuminating ventilator according to a second embodiment of the invention.

Referring to FIG. 5, a second embodiment of an illuminating ventilator is shown and indicated by a reference number of "2." In comparison with the first embodiment, a lamp seat 23 of the illuminating ventilator 2 connects with a housing 211 of a fan 21 of the illuminating ventilator 2. Specifically, the lamp seat 23 connects to a surface of the housing 211 and extends through an opening 221 of a connecting frame 22, wherein said surface of the housing 211 faces the connecting frame 22. Therefore, a receiving portion 231 of the lamp seat 23 is formed on a side of the connecting frame 22 away from the housing 211. With the connection between the housing 211 and the lamp seat 23, it is convenient to electrically link a socket inside the receiving portion 231 and a circuit board of the fan 21, so as to simplify the wire arrangement of the illuminating ventilator 2. Moreover, the housing 211 and the lamp seat 23 can be formed integrally or be connected after shaped separately. As a result, when it is necessary to provide multiple kinds of illuminating ventilators 1 with lamps "L" of different types, only one kind of the connecting frame 22 has to be designed and manufactured for connecting with various kinds of lamp seats 23, which are suitable for different lamps "L" and have the same second coupling portion 122, and no additional die/mold for the connecting frame 22 is necessary. As a result, the manufacturing cost for the illuminating ventilator 1 of the second embodiment is also lowered. Additionally, a cover 24 of the illuminating ventilator 2 is in the form of a circular plate. However, the covers 14, 24 can be in any shape in need, such as a plate with geometric figure like polygon, circle or ellipse.

Figure 6:
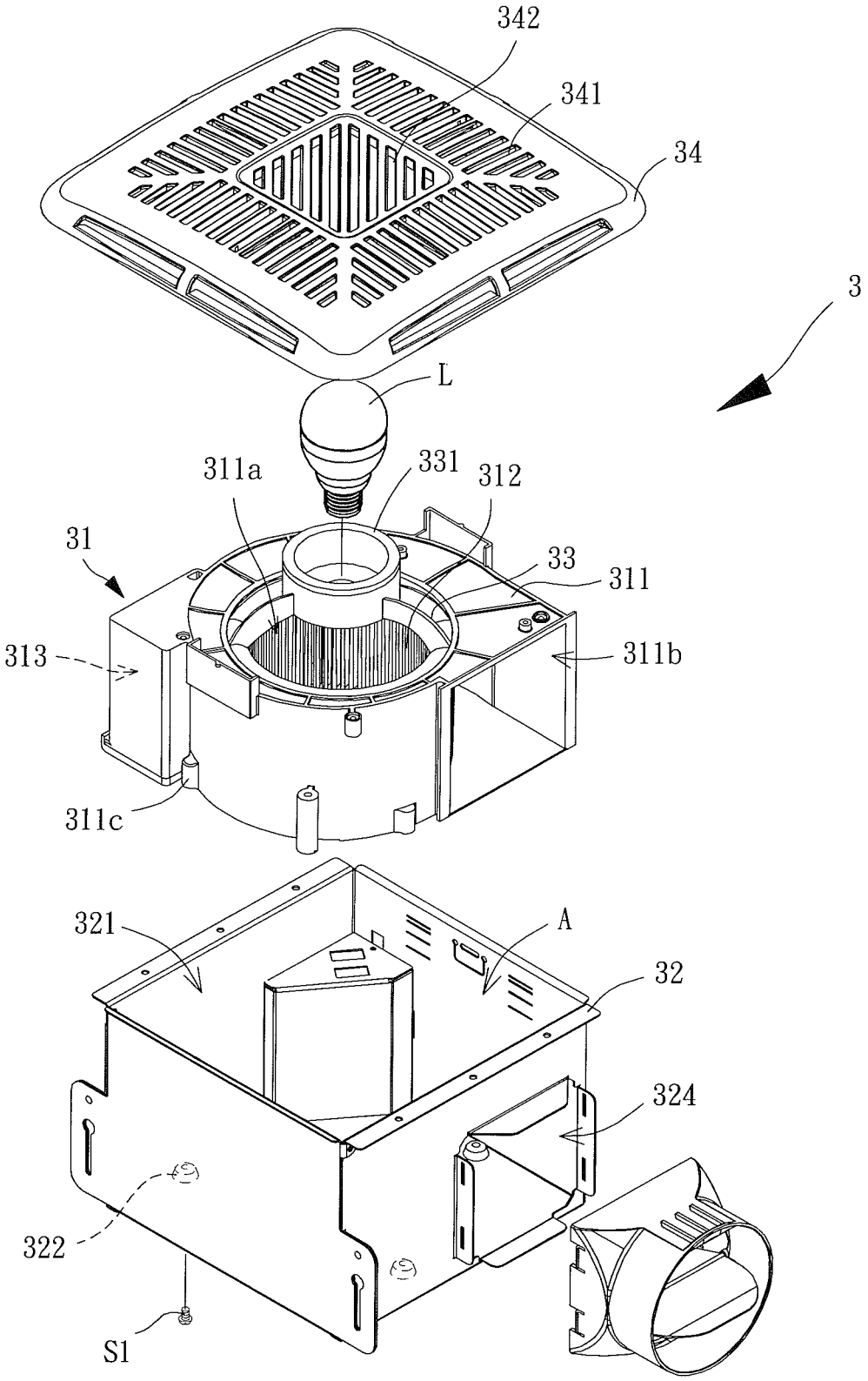
FIG. 6 is an exploded and perspective view of an illuminating ventilator according to a third embodiment of the invention.
Figure 7:
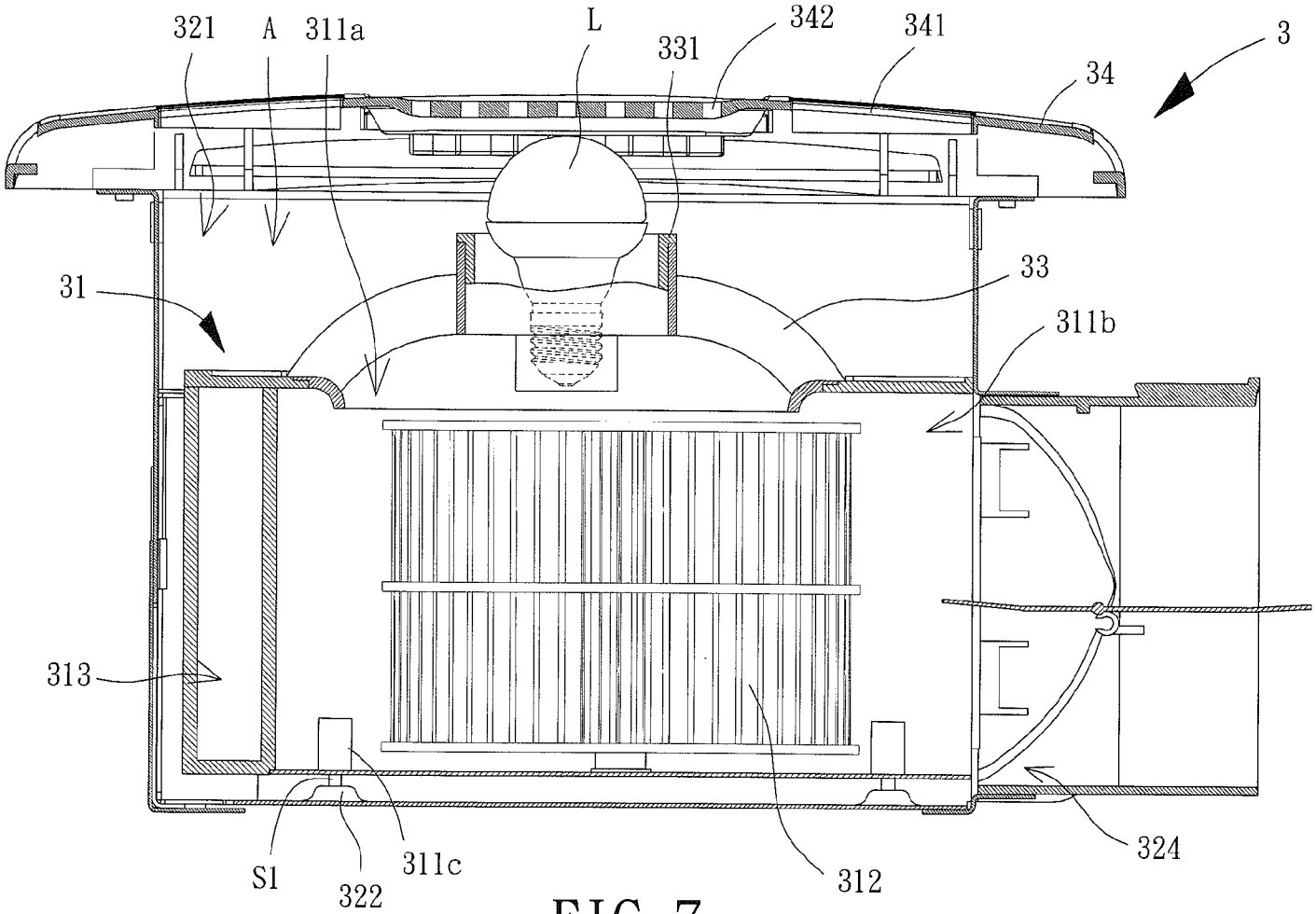
FIG. 7 is a cross-sectional view of the illuminating ventilator according to the third embodiment.

Referring to FIGS. 6 and 7, a third embodiment of an illuminating ventilator is shown and indicated by a reference number of "3." In comparison with the previous illustrated embodiments, a connecting frame 32 of the illuminating ventilator 3 has a receiving room "A" communicating with a first opening 321 and a second opening 324 of the connecting frame 32. The first opening 321 has a diameter larger than that of a housing 311 of a fan 31. Therefore, the fan 31 can be inserted into the receiving room "A" through the first opening 321, with an inlet 311*a* and an outlet 311*b* of the housing 311 in alignment with the first opening 321 and second opening 324 respectively. When the fan 31 is in operation and generates airflows, the airflows can pass through apertures 341 of a cover 34, the opening 321, the inlet 311*a*, the outlet 311*b*, and the second opening 324 sequentially.

A first coupling portion 311*c* of the housing 311 and a second coupling portion 322 of the connecting frame 32 are coupled with each other for firmly fixing the housing 311 inside the receiving room "A" of the connecting frame 32. Accordingly, the fan 31 is inside the receiving room "A" of the connecting frame 32, and thus the connecting frame 32 encloses the housing 311 completely to prolong the lifetime of the illuminating ventilator 3. The connecting frame 32 of this embodiment is larger than the connecting frame 22 of the second embodiment. In this regard, when it is desired to install different types of fans 31 or lamps "L" into the illuminating ventilator 3, the lamp seats 33 corresponding to different types of lamps "L" can be connected to the housings 311. Then, the first coupling portion 311*c* corresponding to the second coupling portion 322 of the connecting frame 32 is arranged on the housing 311 of the fan 31. In this manner, the illuminating ventilator 3 can be applied to different types of fans or lamps "L" without requiring additional die/mold for making the connecting frame 22. As a result, the manufacturing cost for the illuminating ventilator 3 of the third embodiment is also lowered.

Figure 8:
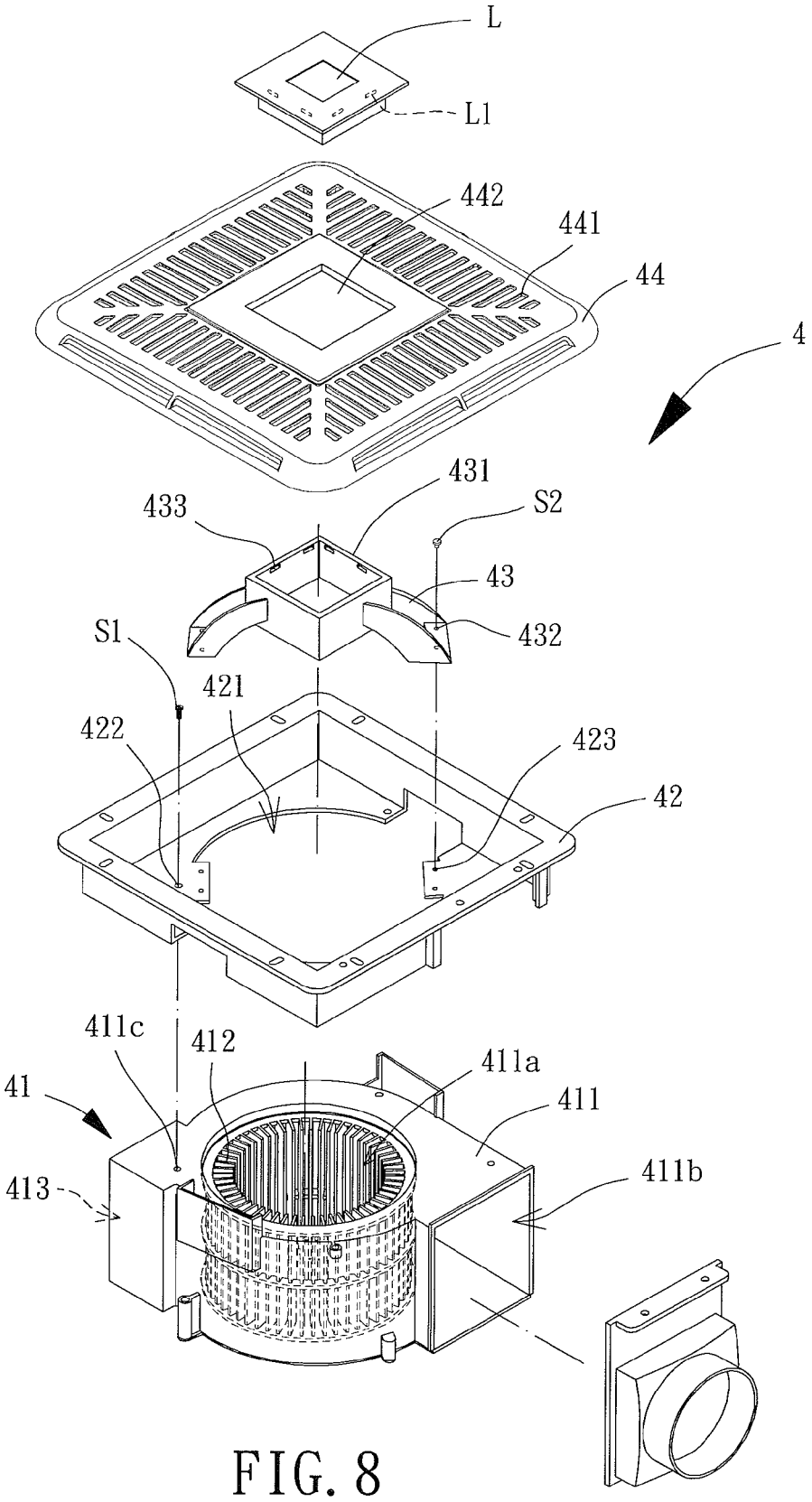
FIG. 8 is an exploded and perspective view of an illuminating ventilator according to a fourth embodiment of the invention.
Figure 9:
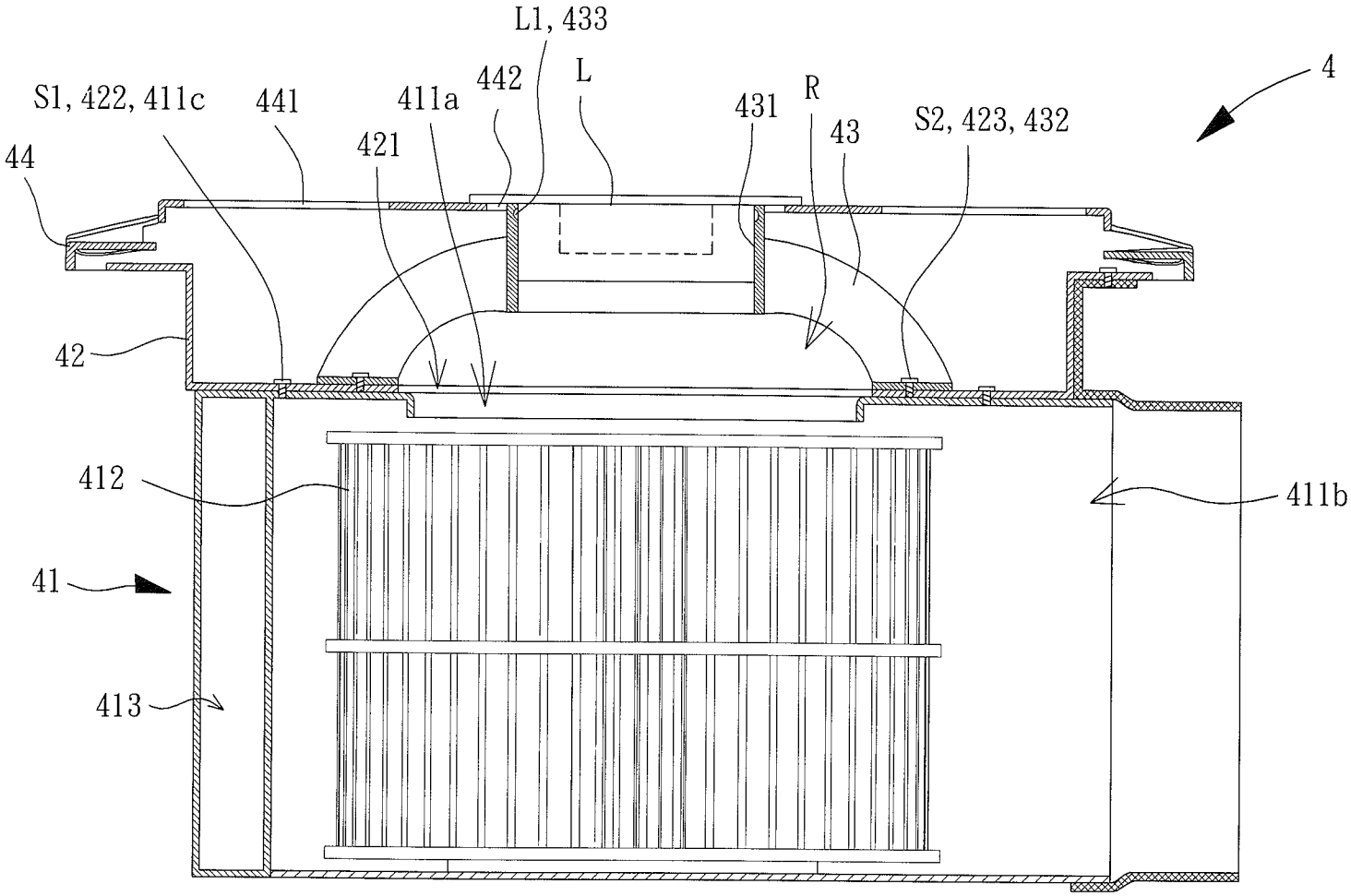
FIG. 9 is a cross-sectional view of the illuminating ventilator according to the fourth embodiment.

Referring to FIGS. 8 and 9, a fourth embodiment of an illuminating ventilator is shown and indicated by a reference number of "4." In comparison with the first embodiment, the lamp "L" is a light-emitting module such as a LED module. The lamp "L" has a first fixing member L1, and a lamp seat 43 of the illuminating ventilator 4 has a second fixing member 433, wherein the first fixing member L1 and second fixing member 433 are preferably a pair of hook and groove able to detachably engage with each other, so that the lamp "L" can be firmly coupled in a receiving portion 431 of the lamp seat 43. However, the first and second fixing members L1, 433 can also be implemented by other conventional and detachable coupling structures.

The fourth embodiment shows that the structure of the proposed illuminating ventilator is not only suitable for conventional bulbs but also able to adopt advanced light devices. Besides, similar to the first embodiment, since a light-transmittable portion 442 of a cover 44 of the illuminating ventilator 4 is a through hole, a user can easily disengage the lamp "L" from a socket in the receiving portion 431 without detaching the cover 44 from a connecting frame 42. Accordingly, the convenience in use of the illuminating ventilator 4 is also much higher than those of the conventional illuminating ventilators 8, 9.

In sum, the proposed illuminating ventilator can surely enhance the performances of cooling and convenience in use and lower the cost of manufacture.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. An illuminating ventilator, comprising:

a fan having a housing and a fan wheel, wherein the housing has a first coupling portion, an inlet, an outlet and an inner space communicating with said inlet and outlet, and the fan wheel is received in the inner space;

a connecting frame coupling with the housing and having an opening in alignment with the inlet of the housing, wherein the connecting frame has a second coupling portion coupling with the first coupling portion of the housing;

a lamp seat mounted on one of the connecting frame and the housing and having a receiving portion for receiving a lamp; and a cover coupled with the connecting frame and having a plurality of apertures communicating with the opening.

2. The illuminating ventilator as claimed in claim 1, wherein the lamp seat is mounted on a surface of the connecting frame, said surface faces away from the housing and is close to the opening, the receiving portion is formed on a side of the connecting frame, and said side is away from the housing.

3. The illuminating ventilator as claimed in claim 1, wherein the lamp seat is mounted on a surface of the housing and extends through the opening of the connecting frame, said surface faces the connecting frame, the receiving portion is formed on a side of the connecting frame, and said side is away from the housing.

4. The illuminating ventilator as claimed in claim 1, wherein the cover has a light-transmittable portion in alignment with the receiving portion of the lamp seat.

5. The illuminating ventilator as claimed in claim 4, wherein the light-transmittable portion is a through hole for the lamp to be passed therethrough.

6. The illuminating ventilator as claimed in claim 1, wherein the receiving portion of the lamp seat is in alignment with the inlet of the housing.

7. The illuminable ventilator as claimed in claim 1, wherein each of the first and second coupling portions has a plurality of holes, wherein the plurality of holes of the first coupling portion is aligned with the plurality of holes of the second coupling portion respectively, and a plurality of fixing member penetrates aligned pairs of the holes.

8. The illuminating ventilator as claimed in claim 1, wherein the connecting frame has a first connecting portion, the lamp seat has a second connecting portion, and the first and second connecting portions connect with each other.

9. The illuminating ventilator as claimed in claim 8, wherein each of the first and second connecting portions has a plurality of holes, wherein the plurality of holes of the first coupling portion serving as the first connecting portion is aligned with the plurality of holes of the second coupling portion serving as the second connecting portion respectively, and a plurality of fixing member penetrates aligned pairs of the holes.

10. The illuminating ventilator as claimed in claim 1, wherein a socket is arranged inside the receiving portion for electrically connecting to the lamp.

11. The illuminating ventilator as claimed in claim 1, wherein the housing connects with a container for containing a power supply for the fan or the lamp.

12. The illuminating ventilator as claimed in claim 1, wherein the connecting frame has a receiving room inside, the fan is received in the receiving room, the opening of the connecting frame serves as a first opening, the connecting frame further has a second opening, the first and second openings communicate with the receiving room, the first opening aligns with the inlet, and the second opening aligns with the outlet.

13. The illuminating ventilator as claimed in claim 1, wherein the lamp received in the receiving portion of the lamp seat is a light-emitting module, the receiving portion has a socket for electrically connecting with the lamp.

14. The illuminating ventilator as claimed in claim 13, wherein the lamp has a first fixing member, the lamp seat has a second fixing member, and the first and second fixing members detachably engage with each other.

* * * * *